US005802901A

United States Patent [19]

Oda et al.

[11] Patent Number: 5,802,901

[45] Date of Patent: Sep. 8, 1998

[54] PROCESS FOR CORRECTING THE DISTORTION OF ELECTROLYTIC SEED PLATES

[75] Inventors: Hirohisa Oda, Niihama; Masamichi Miyauchi, Yamato; Akinori Miura, Niihama; Kenichi Moriyama, Niihama; Tsuneo Funahashi, Niihama; Yukihisa Moriya, Niihama; Katsushi Takeda, Niihama, all of Japan

[73] Assignees: Sumitomo Metal Mining Co.,Ltd., Tokyo; Kawazoe Machine Works, Ltd., Amagasaki, both of Japan

[21] Appl. No.: 915,085

[22] Filed: Aug. 20, 1997

Related U.S. Application Data

[63] Continuation of Ser. No. 578,938, Dec. 27, 1995, abandoned.

[30] Foreign Application Priority Data

Dec. 27, 1994 [JP] Japan ..... 6-338079

[51] Int. Cl.[6] ..... B21D 1/02; B21D 3/02; B21B 15/00

[52] U.S. Cl. ..... 72/161; 72/160

[58] Field of Search ..... 72/160, 161, 162, 72/163, 164, 165, 166, 167, 168

[56] References Cited

U.S. PATENT DOCUMENTS

| | | | |
|---|---|---|---|
| 3,597,952 | 8/1971 | Soda | 72/163 |
| 3,678,720 | 7/1972 | Dickey et al. | 72/160 |
| 3,828,599 | 8/1974 | Withrow | 72/163 |
| 3,834,202 | 9/1974 | Kawaguchi et al. | 72/163 |
| 3,958,439 | 5/1976 | Kawaguchi et al. | 72/163 |
| 4,587,822 | 5/1986 | Bradlee | 72/163 |
| 4,633,697 | 1/1987 | Blough | 72/164 |
| 4,651,549 | 3/1987 | Masui | 72/161 |
| 4,819,470 | 4/1989 | Noe' et al. | 72/161 |
| 5,412,968 | 5/1995 | Benz | 72/164 |

FOREIGN PATENT DOCUMENTS 5555857 12/1989 Japan .

*Primary Examiner*—Lowell A. Larson
*Assistant Examiner*—Rodney Butler
*Attorney, Agent, or Firm*—Watson Cole Stevens Davis, P.L.L.C.

[57] ABSTRACT

Bent or twisted electrolytic seed plates are caused to undergo primary straightening by a total of at least 15 vertically staggered work rolls having a diameter not exceeding 50 mm. Then, ribs are formed on the seed plates by groove-forming rolls having annular flanges along their outer periphery, and the plates are caused to undergo secondary straightening by rolls having annular grooves along their outer periphery.

4 Claims, 4 Drawing Sheets

PROCESS FOR CORRECTING THE DISTORTION OF ELECTROLYTIC SEED PLATES

CROSS-REFERENCE TO RELATED APPLICATION

This application is a continuation of application Ser. No. 08/578,938, filed Dec. 27, 1995, now abandoned.

BACKGROUND OF THE INVENTION

1. Field of the Invention

This invention relates to a process for correcting the distortion of seed plates which are used for the electrolytic refining or winning of a metal.

2. Description of the Prior Art

The electrolysis of a metal which is typically intended for refining or winning is usually carried out in an electrolytic cell in which mother or crude metal plates used as the anode plates and seed or cathode plates are alternately arranged. Referring, for example, to the electrolysis of copper, seed or cathode plates and anode plates cast from crude copper are alternately arranged in an electrolytic cell, and as electrolysis proceeds copper is dissolved from the anode plates and deposited on the seed plates.

In order to achieve an improved productivity in any such electrolytic operation, it is necessary to dispose the anode (or mother) plates and the cathode (or seed) plates as close to each other as possible in the electrolytic cell and to conduct electrolysis by employing as high a current density as reasonably possible. If the anode and cathode plates are too close to each other, however, they are very likely to contact each other and thereby cause short circuiting, resulting in not only a waste of electric current, or a lowering of electrolytic efficiency, but also a variation in the amount of electric current flowing to the anode and cathode plates. If the cathode plates are irregular in shape, they are very likely to contact the anode plates, and even if they do not, short circuiting is very likely to occur due to the concentration of electric current on the protruding or bent portions of the cathode plates. Therefore, the seed plates employed as the cathode plates in an electrolytic cell are required to be regular or uniform in shape, including flatness.

A thin sheet formed by electrolytic deposition and which is stripped off a mother plate is usually employed as a seed plate in the electrolysis of a metal. A flat sheet is, however, difficult to obtain, since a thin sheet formed by electrolytic deposition is often distorted during its deposition or when stripped off the mother plate, or is very easily bent during its transportation or handling. It has, therefore, been usual to form ribs on a seed plate by a press for preventing it from bending, or to remove its distortion, but as the seed plate formed by electrolytic deposition usually has a thickness which is large in its central portion and small in its edge portion, there is every likelihood that even the ribs may be unable to prevent the plate from being twisted by a spring-back phenomenon. Moreover, the continuous straightening treatment of seed plates by a press has the disadvantage that the wear of dies brings about a reduction of straightening accuracy, or working efficiency.

In order to overcome these problems, we have previously proposed an apparatus for making a substantially distortion-free and satisfactorily flat seed plate by continuous roller treatment (see Japanese Utility Model Publication No. Sho 55-55857). This apparatus comprises a roller leveler consisting of a plurality of vertical staggered work rolls for bending a plate repeatedly, groove-forming rollers consisting of rolls having a plurality of annular flanges along their outer periphery, and straightening rollers having a plurality of annular grooves along their outer periphery. The apparatus is fed with electrolytic seed plates one after another, and the roller leveler performs primary straightening, the groove-forming rollers form ribs thereon, and the straightening rollers perform secondary straightening. The roller leveler removes internal stress from the seed plates in the direction of their feed through the apparatus, the groove-forming rollers stretch the seed plates transversely, and the straightening rollers remove the residual strain from the seed plates. Thus, the apparatus has the advantage of being able to continuously manufacture substantially distortion-free and satisfactorily flat seed plates.

The apparatus described above can make seed plates which are by far superior in flatness to ones having ribs formed by a press, or ones from wherein distortion has been removed merely by a roller leveler, since 200 to 300 plates have shown an average value, x, of 9.0 mm as the residual strain and a standard deviation, $\sigma$, of 3.7 mm. It is, however, desirable to prepare still more distortion-free seed plates having a higher degree of flatness in order to achieve a further improvement in the efficiency of electrolytic operation.

SUMMARY OF THE INVENTION

Under these circumstances, it is an object of this invention to provide a process which can correct the distortion of electrolytic seed plates to make seed plates of high quality having substantially no bent or twisted portion very efficiently irrespective of the properties, such as thickness and unit weight, of the seed plates.

We have conducted a great deal of research and experimental work to improve the performance of the apparatus described above, and particularly, to find out the optimum diameter and number of rolls in a roller leveler, and have been able to develop a process which can effectively straighten bent or twisted electrolytic seed plates and make seed plates having substantially no residual strain Thus, the above object is attained by a process which includes feeding seed plates to a roller leveler composed of a plurality of vertically staggered work rolls and adapted to bend the plates repeatedly for their primary straightening, then to groove-forming rollers composed of rolls having a plurality of annular flanges along their outer periphery and adapted to form ribs on the seed plates, and straightening rollers having a plurality of annular grooves along their outer periphery and adapted to perform the secondary straightening of the plates, wherein the work rolls in the roller leveler have a diameter not exceeding 50 mm and are at least 15 in number.

The seed plates straightened by the process of this invention contribute greatly to improving the efficiency of any electrolytic operation carried out by employing those seed plates.

DETAILED DESCRIPTION OF THE INVENTION

The process of this invention employs for the primary straightening of seed plates a roller leveler which comprises at least 15 vertically staggered work rolls having a diameter not exceeding 50 mm.

Figure 1A:
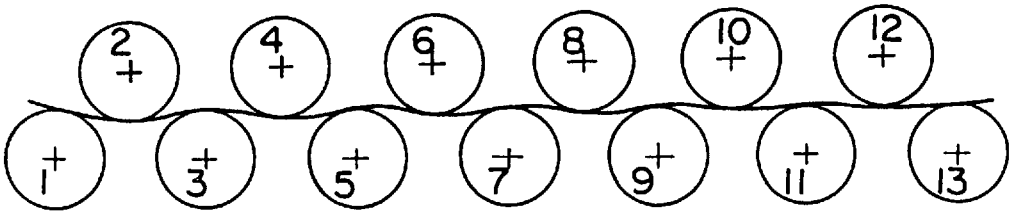
FIG. 1(A) is a diagram showing by way of example the arrangement of work rolls in a roller leveler and a seed plate as employed for analyzing by simulation the relation between the diameter and number of the work rolls and the final curvature of the seed plate.
Figure 1B:
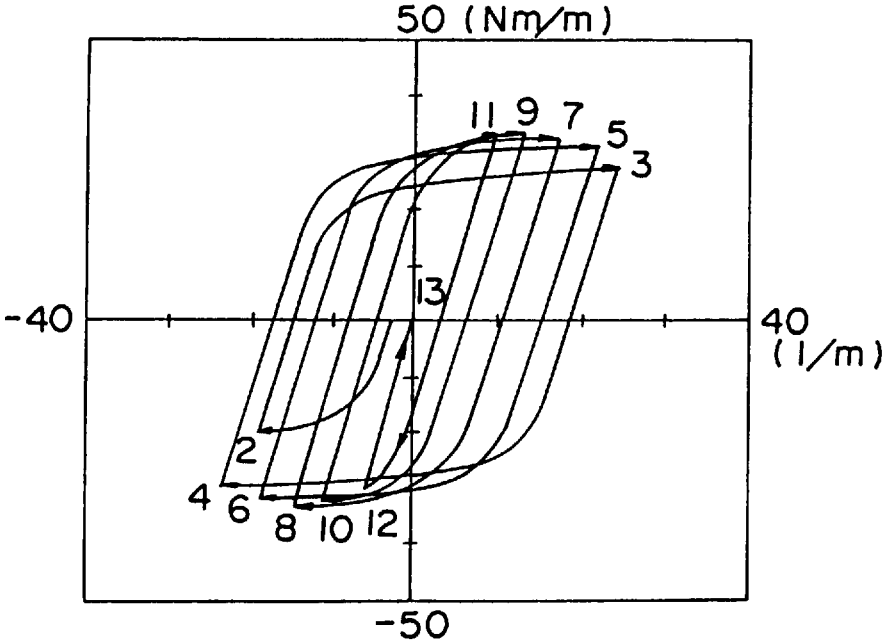
FIG. 1(B) is a graph showing the curvature of the seed plate shown in FIG. 1(A) in relation to the value as obtained by dividing by the width of the seed plate the internal stress (or moment) produced in the seed plate bent by the work rolls.

A simulation was made for analyzing the relations between the diameter and number of the work rolls and the final curvature of a seed plate. FIG. 1(A) shows the arrangement of the work rolls and the seed plate as employed for the simulation, and FIG. 1(B) is a graph showing the curvature of the seed plate in relation to the value obtained by dividing by the width of the seed plate the value of the internal stress (or moment) produced in the seed plate bent by the work rolls. In FIG. 1(B), the numeral given to each curve is the serial number of the corresponding roll as shown in FIG. 1(A), and indicates the point where the seed plate contacts that roll. FIG. 1(B) shows that the seed plate having an initial curvature of 3.3 had a final curvature of 0.173192 as a result of its repeated bending by the work rolls.

The curves in FIG. 1(B) were obtained by employing data obtained from preliminary tensile tests on copper and shown in Table 1 below, and calculating the values of $\alpha$, n, $\sigma_0$, and $\epsilon_0$ in the Ramberg-Osgood formula as stated below.

TABLE 1

| | |
|---|---|
| Young's modulus (GPa) E = 117 | |
| Coefficients in the formula: | |
| $\alpha$ = 3.08729E − 0.4 | |
| n = 6.79524 | |
| Plate thickness (mm): t = 0.8 | |
| Rolling depth (mm): | D2 = 4 |
| | D4 = 2 |
| | D6 = 1 |
| | D8 = 0.5 |
| | D10 0.3 |
| | D12 = 0 |
| Initial curvature (l/m): ko = 3.3 | |
| Final curvature (1/m): ka = 0.173192 | |
| Ramberg-Osgood formula: | |
| $\epsilon/\epsilon_0 = + \sigma/\sigma_0 + \alpha(\sigma/\sigma_0)^n$ | |
| where | $\epsilon$: strain (%); |
| | $\sigma$: stress (Pa) |

If the dimensions and arrangement of the work rolls are specified, it is possible to determine the relation between the curvature of a seed plate and its strain ($\epsilon$) from the Ramberg-Osgood formula and it is, therefore, possible to calculate the stress ($\sigma$) developing in the seed plate. Each curve in FIG. 1(B) shows the moment as divided by the width of the plate.

Figure 2:
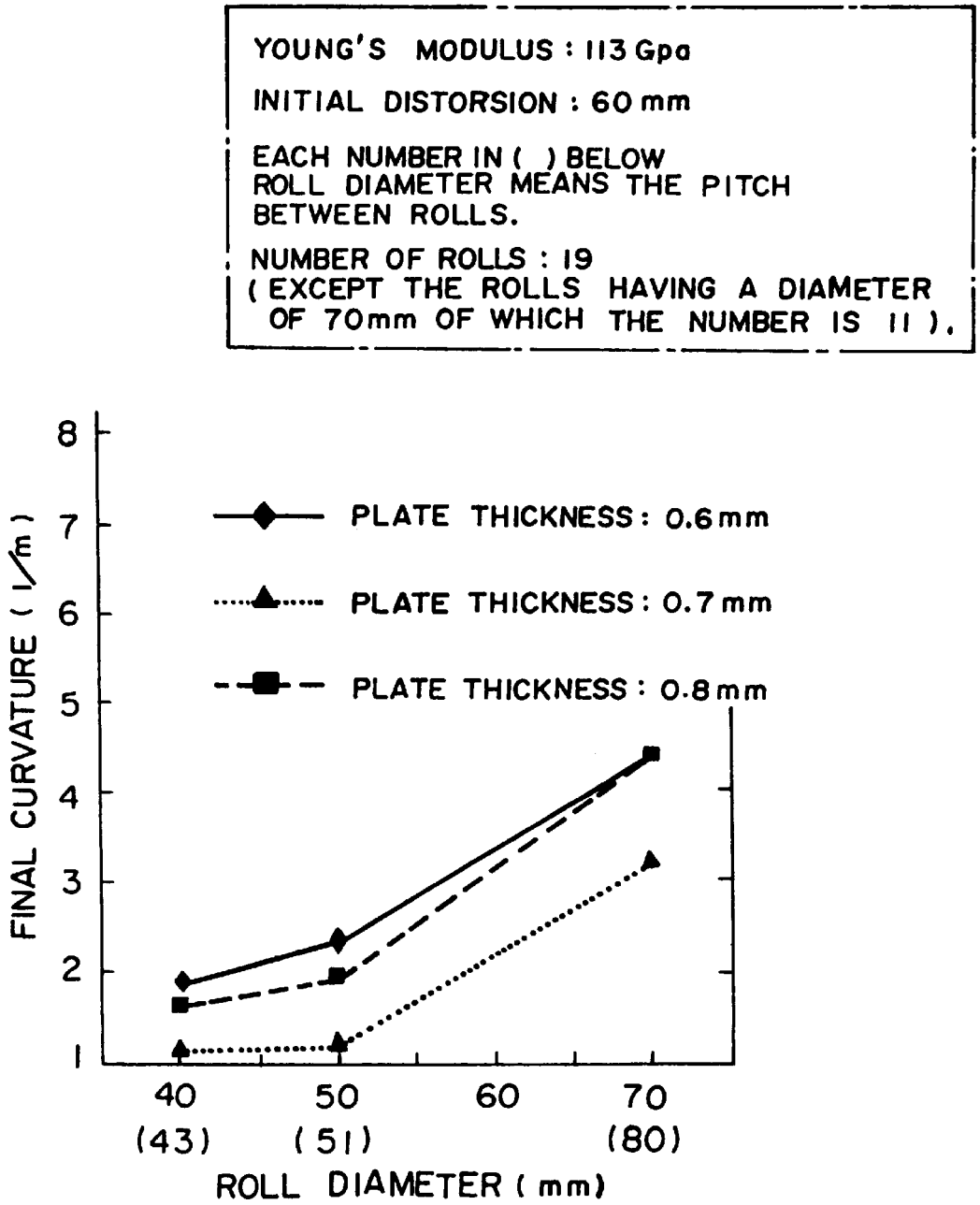
FIG. 2 is a graph showing the relation between the diameter of the work rolls and the final curvature of the seed plate as analyzed by the simulation shown in FIGS. 1(A) and 1(B)
Figure 3:
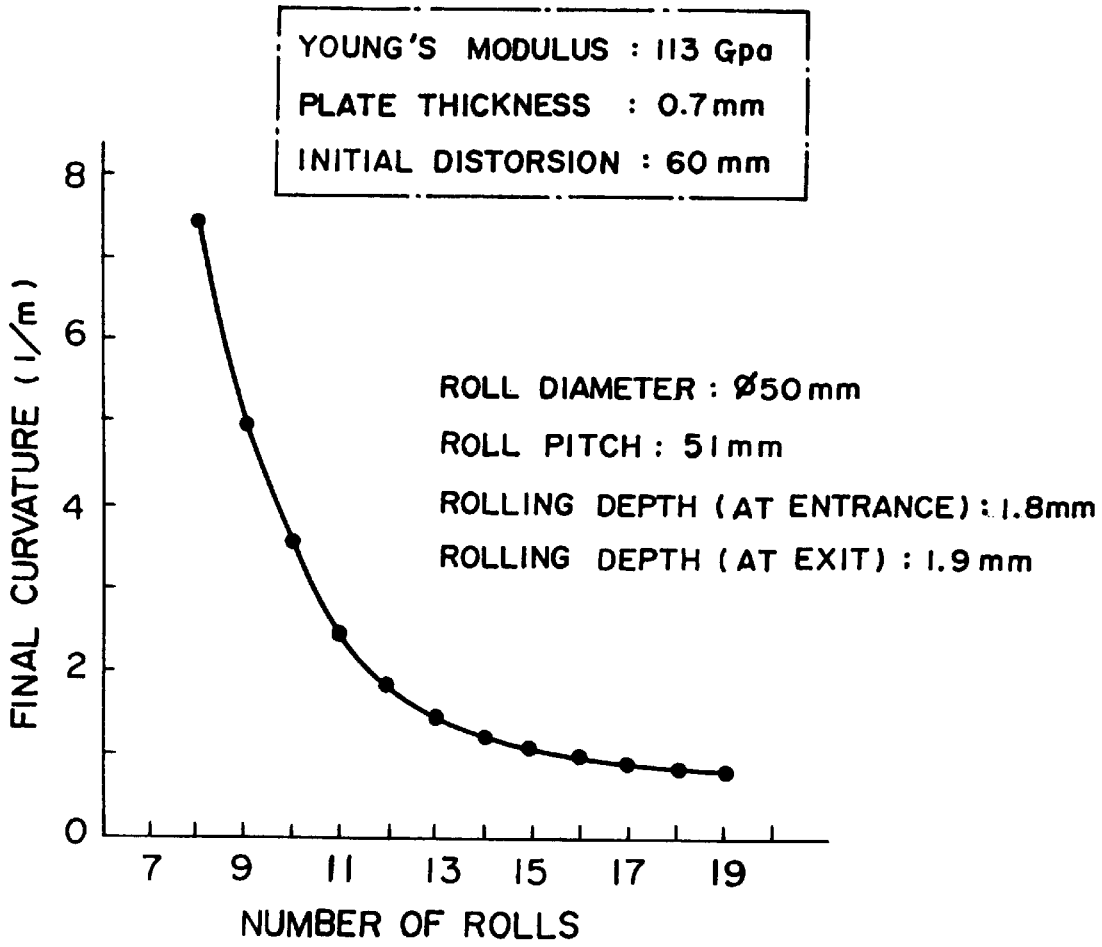
FIG. 3 is a graph showing the relation between the number of the work rolls and the final curvature of the seed plate as analyzed by the simulation.

FIG. 2 shows the relation between the diameter of the work rolls and the final curvature of the seed plate as analyzed by the simulation, and indicates that all of the plates tested and having different thicknesses have a small final curvature if the work roll diameter does not exceed 50 mm. FIG. 3 shows the relation between the number of the work rolls and the final curvature of the seed plate as analyzed by the simulation, and indicates that the plates have a small final curvature if at least 15 work rolls are employed.

These results confirm that the roller leveler can effectively remove distortion from the seed plates or straighten them if it includes at least 15 work rolls having a diameter not exceeding 50 mm. While the work rolls having a smaller diameter are more effective for removing distortion, it is better not to be smaller than about 30 mm, since the rigidity of the seed plate and the flexure of the work rolls have to be taken into consideration. While the use of more work rolls is likewise more effective, their number should not exceed about 20, if the ease of operation and the absence of any outstanding difference in effect are considered.

After its primary straightening by the roller leveler, the seed plate is passed to a plurality of sets of groove-forming rollers composed of rolls having a plurality of annular flanges along their outer periphery, whereby ribs are formed on the seed plate. Then, the seed plate is fed to a plurality of sets of straightening rollers having a plurality of annular grooves along their outer periphery, whereby a plurality of ridges and grooves are formed in the plate. Thus, there is obtained a highly flat seed plate having grooves which minimize its further deformation.

The invention will now be described more specifically by way of a few examples.

EXAMPLE 1

Figure 4:
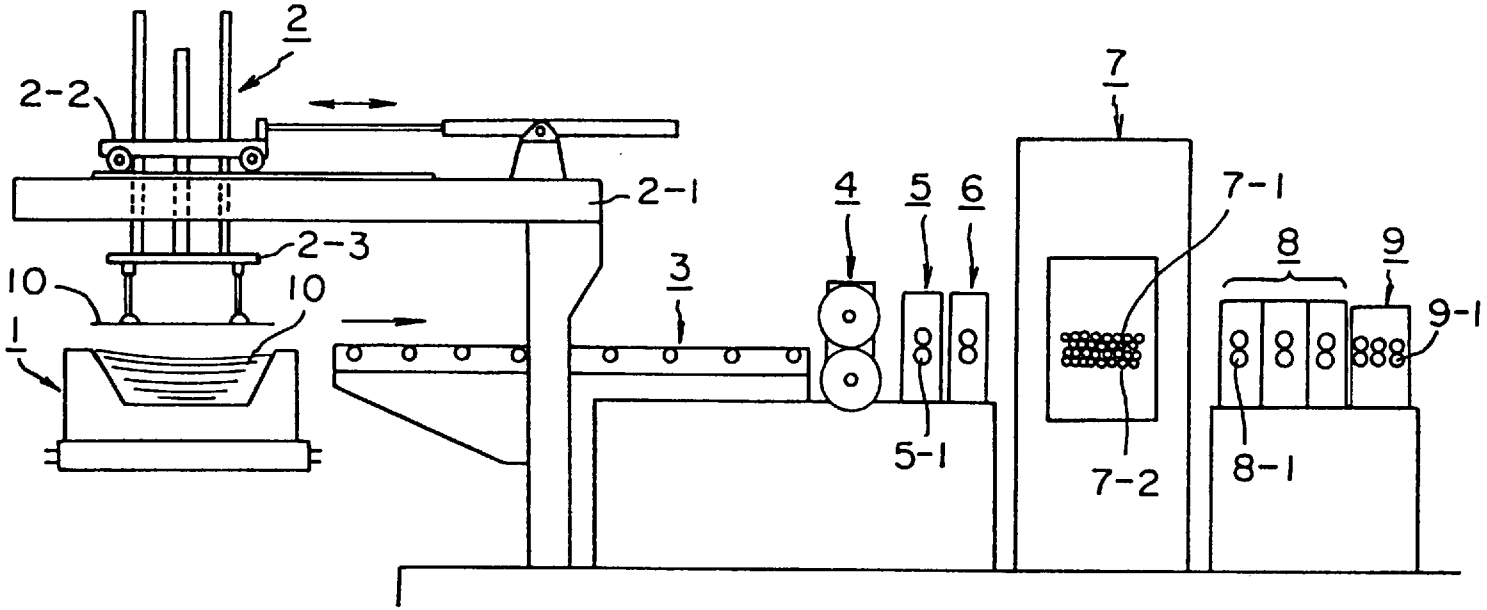
FIG. 4 is a schematic elevational view of an apparatus which can be employed for carrying out the process of this invention.

FIG. 4 schematically shows an apparatus which can be employed for carrying out the process of this invention. The apparatus includes a pallet conveyor 1 for seed plates 10, a vacuum seed plate transfer device 2, a roller conveyor 3, pinch rollers 4, a surface smoothing roller 5, pinch rollers 6, a roller leveler 7, a groove-forming roller 8, and a straightening roller 9.

The pallet conveyor 1 conveys a stack of bent or twisted electrolytic seed plates 10 in a pallet. The vacuum seed plate transfer device 2 includes a carriage 2-2 which is horizontally movable on a platform 2-1 by a horizontal fluid-pressure cylinder, and a vacuum suction plate 2-3 suspended from the carriage 2-2 vertically movably by a vertical fluid-pressure cylinder for lifting the seed plates 10 one by one from the pallet to transfer each seed plate 10 onto the roller conveyor 3. The roller conveyor 3 is installed substantially at the level of height with the pallet conveyor 1 and at right angles thereto for conveying the seed plates 10 from the vacuum transfer device 2 to the straightening part of the apparatus as will hereinafter be described. The surface smoothing roller 5 comprises a pair of vertically spaced apart rolls 5-1 for giving a smooth surface to each seed plate by depressing granular protrusions or burrs formed on the plate surface during electrolysis.

The roller leveler 7 comprises a multiplicity of vertically staggered work rolls 7-1 supported by backup rolls 7-2. The leveler 7 shown in FIG. 4 has four layers of rolls. According to a salient feature of this invention, the roller leveler 7 includes at least 15 vertically staggered work rolls 7-1 having a diameter not exceeding 50 mm.

The groove-forming roller 8 comprises a plurality of pairs of vertically spaced apart rolls 8-1 each having a plurality of annular flanges along its outer periphery. When a seed plate is passed between each pair of rolls 8-1, the annular flanges thereof form a plurality of ribs on the seed plate along its edges and middle portion in parallel to its length.

The straightening roller 9 comprises a plurality of pairs of vertically spaced apart rolls 9-1 for removing the distorsion of the seed plate by straightening it except its ribs formed by the rolls 8-1. Each roll 9-1 has a plurality of annular grooves which allow the ribs to pass without being depressed.

The pinch rollers 4 are provided for feeding each seed plate 10 from the roller conveyor 3 to the surface smoothing roller 5, and the pinch rollers 6 for feeding it from the surface smoothing roller 5 to the roller leveler 7. The seed plate 10 is repeatedly bent by the upper and lower work rolls 7-1, and is thereby substantially straightened (primary straightening). The optimum spacing between the upper and lower work rolls 7-1, as well as between the backup rolls 7-2, depends on dimensional factors including the thickness of the seed plate to be straightened. After its primary straightening, the seed plate 10 has a plurality of grooves formed in its surface by the groove forming roller 8, and is, then, subjected to secondary (or final) straightening by the straightening roller 9. The optimum positions of the grooves to be formed by the roller 8 and the optimum amount of force to be thereby applied onto the seed plate depend on the adequate selection of the positions of the annular flanges on the upper and lower rolls 8-1, their spacing and the rolling pressure.

EXAMPLE 2

Seed plates as stripped off mother plates, and having a length of 1070 mm, a width of 104 mm and a thickness of 0.7±0.5 mm were straightened by employing an apparatus as shown in FIG. 4, and including a roller leveler composed of 19 work rolls having a diameter of 40 mm. Each seed plate as finally straightened was vertically suspended from a cross bar by a hanger and its thickness as projected on a horizontal plane was measured as indicating the amount of its residual distortion. A total of 200 to 300 plates were so tested, and an average of the results and a standard deviation were calculated. The plates straightened by the process of this invention had an average value, x, of 6.5 mm as the residual strain and a standard deviation, $\sigma$, of 2.7 mm, while those straightened by the apparatus described in Japanese Utility Model Publication No. Sho 55-55857 as stated above showed an average residual strain, x, of 9.0 mm and a standard deviation, $\sigma$, of 3.7 mm. These results confirm that the process of this invention can make seed plates having a drastically improved level of flatness and keep any later deformation thereof to a minimum.

What is claimed is:

1. In a process for correcting the distortion of electrolytic seed plates which includes feeding seed plates having predetermined lengths through a roller leveler composed of a plurality of vertically staggered work rolls and adapted to bend said plates repeatedly for primary straightening, then through a plurality of sets of groove-forming rolls having a plurality of annular flanges along their outer periphery and adapted to form ribs on said plates, and then through a plurality of sets of straightening rolls having a plurality of annular grooves along their outer periphery and adapted to perform secondary straightening of said plates, the improvement wherein said work rolls have a diameter not exceeding 50 mm and are at least 15 in number, and wherein said seed plates are not subjected to tension by a coiler or an uncoiler.

2. A process as set forth in claim 1, wherein said diameter is at least about 30 mm.

3. A process as set forth in claim 1, wherein said number is less than about 20.

4. A process as set forth in claim 2, wherein said number is less than about 20.

* * * * *